United States Patent [19]

Li et al.

[11] Patent Number: 4,906,953

[45] Date of Patent: Mar. 6, 1990

[54] BROADBAND MICROSTRIP TO COPLANAR WAVEGUIDE TRANSITION BY ANISOTROPIC ETCHING OF GALLIUM ARSENIDE

[75] Inventors: Chia-Geng Li, Fremont; Steve G. Bandy, Sunnyvale; Majid Riaziat, Union City, all of Calif.

[73] Assignee: Varian Associates, Inc., Palo Alto, Calif.

[21] Appl. No.: 241,638

[22] Filed: Sep. 8, 1988

[51] Int. Cl.[4] ..... H01P 5/08

[52] U.S. Cl. ..... 333/33; 333/246

[58] Field of Search ..... 333/33, 238, 246

[56] References Cited

U.S. PATENT DOCUMENTS 4,543,544 9/1985 Ziegner ..... 333/238 X 4,806,892 2/1989 Thorpe et al. ..... 333/246

OTHER PUBLICATIONS

Riaziat et al., "Coplanar Waveguides for MMICs", *Microwave Journal*, Jun. 1987, pp. 125–131.

Riaziat et al., "Single Mode Operation of Coplanar Waveguides", *Electronics Letters*, vol. 23, No. 24, Nov. 1987, pp. 1281–1283.

*Primary Examiner*—Paul Gensler

*Attorney, Agent, or Firm*—Stanley Z. Cole; Gerald M. Fisher; Peter J. Sgarbossa

[57] ABSTRACT

A broadband interconnection between a microstrip and a coplanar waveguide is provided without use of via holes by using anisotropic etching to form a sloped surface between connection points. The sloped surface is then metallized to provide the interconnection.

3 Claims, 5 Drawing Sheets

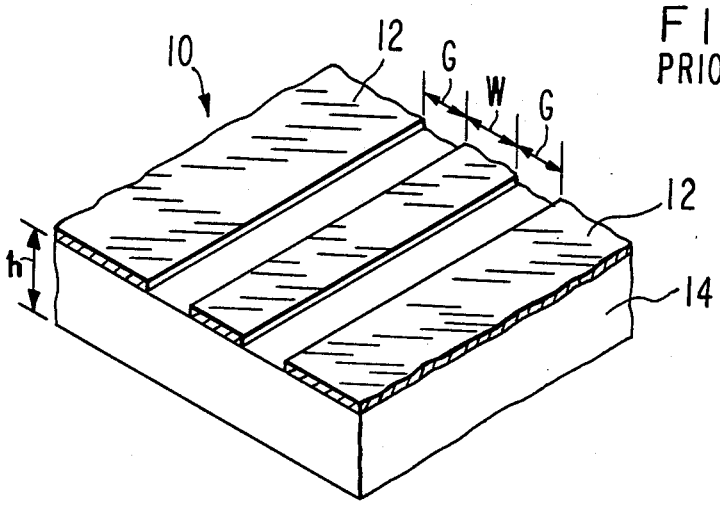
FIG. 1
PRIOR ART
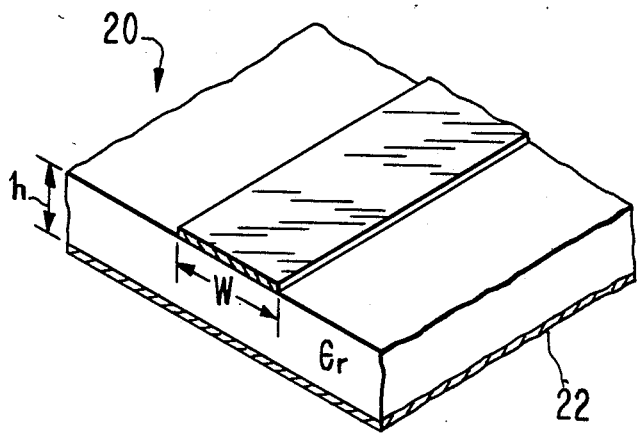
FIG. 2
PRIOR ART
FIG. 3
PRIOR ART
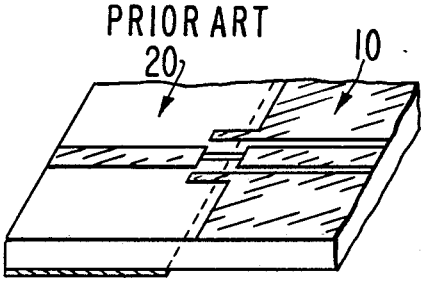
FIG. 4
PRIOR ART
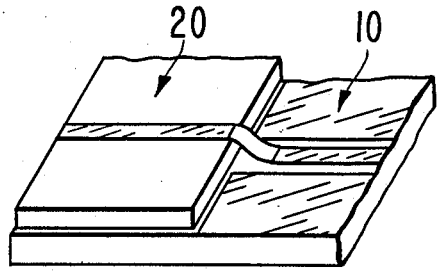

BROADBAND MICROSTRIP TO COPLANAR WAVEGUIDE TRANSITION BY ANISOTROPIC ETCHING OF GALLIUM ARSENIDE

FIELD OF THE INVENTION

This invention pertains to a method and apparatus for connecting dissimilar miniature electronic transmission lines, more particularly for broadband connection of a microstrip to a coplanar waveguide.

BACKGROUND OF THE INVENTION

Electronic devices for ultra-high frequency microwave signals (>10 GHz) are difficult to design because interconnections have unintentional capacitance and inductances, causing undesirable side effects. Dissimilar families of microwave electronic devices, desirable approaches in themselves, become an extremely difficult problem to put together without causing parasitic distortions of the signal.

At microwave frequencies there are no simple interconnects to be used in integrated circuits. Simple low frequency interconnects show dispersion, attenuation, and phase shift at microwave frequencies and therefore have to be designed and treated as transmission lines. There are a number of popular transmission line geometries available for microwave circuits. The simplest and most widely used structure is shown in FIG. 2. This structure is known as a microstrip. (See T. C. Edwards, Foundations for Microstrip Circuit Design, John Wiley and Sons, 1981.) A microstrip consists of a metal strip of controlled width on the surface of the semiconductor or ceramic substrate. The other side of the substrate is completely metalized and forms the microstrip ground plane. Another transmission medium used in microwave circuits is known as coplanar waveguide (CPW) which is shown in FIG. 1. The difference between CPW and microstrip is that CPW has all the conductors including the ground plane on the same side of the substrate adding the advantage of easier access to ground.

Microstrip and CPW are generally not combined on the same monolithic circuit. But it is desirable to be able to connect CPW circuits to microstrip circuits in order to form larger subsystems.

OBJECTS OF THE INVENTION

An object of the invention is to provide a broadband transition for microstrip to coplanar waveguide in a GaAs monolithic circuit.

It is a further object of the invention to provide such a transition without the use of via holes in the GaAs substrate.

SUMMARY OF THE INVENTION

These objects of the invention and other objects, features and advantages to become apparent as the specification progresses are accomplished by the invention according to which, briefly stated, a procedure is described for making a broadband transition between a microstrip line and a coplanar waveguide on a thick GaAs substrate. In order to form a broadband transition between two transmission media, it is necessary to minimize the parasitic reactances associated with the geometrical discontinuities of the transition. In order to achieve this for a transition between microstrip and coplanar waveguide, we keep the center conductors vertically at the same level connected by a tapered section. The ground planes therefore can not be at the same vertical level and need to be connected by a low inductance path. This is achieved by a metalized sloped wall formed by anisotropic etching of GaAs. In silicon monolithic circuits, the need for the extra bandwidth that this transition offers does not exist, because silicon integrated circuits are not yet fast enough. The advantage of GaAs circuits is their added speed. It is at these high frequencies (greater than about 10 GHz) where GaAs integrated circuits operate that the extra bandwidth becomes necessary.

These and further constructional and operational characteristics of the invention will be more evident from the detailed description given hereinafter with reference to the figures of the accompanying drawings which illustrate one preferred embodiment and alternatives by way of non-limiting examples.

BRIEF DESCRIPTION OF THE DRAWINGS

FIG. 1 shows a schematic of a coplanar waveguide.

FIG. 2 shows a schematic of microstrip.

FIG. 3 is a schematic of the planar approach for coplanar waveguide to microstrip transitions.

FIG. 4 is a schematic of the coplanar ground planes approach to coplanar waveguide to microstrip transitions.

LEXICON

Figure 5:
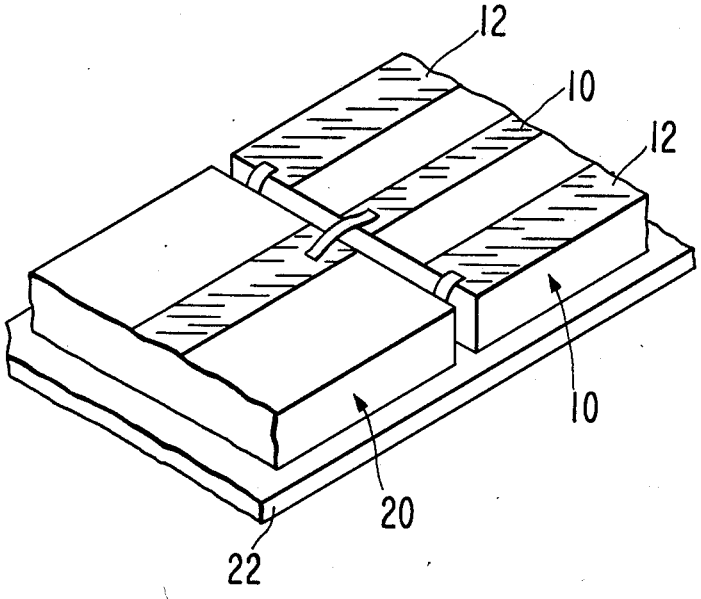
FIG.5 PRIOR ART
FIG. 5 is a schematic of the coplanar center conductors approach to coplanar waveguide to microstrip transitions.

The portion of the electromagnetic spectrum between UHF and infrared is normally referred to as microwaves. It corresponds to the frequency range between 1 GHz and 300 GHz.

A transmission line is a structure used to guide the electromagnetic wave. Microstrip and coplanar waveguide are examples of transmission lines.

A transmission line is normally used in a regime where it can carry only one propagation mode. Other propagation modes unintentionally excited are referred to as extraneous modes. (See: Ramo et al., Fields and Waves in Communication Electronics, John Wiley and Sons, 1967.)

GLOSSARY

The following is a glossary of elements and structural members as referenced and employed in the present invention.

| | |
|---|---|
| 10 | coplanar waveguide |
| 12 | ground plane of the coplanar waveguide |
| 14 | wafer |
| 20 | microstrip |
| 22 | ground plane of the microstrip |
| 30 | via hole |

DESCRIPTION OF THE PREFERRED EMBODIMENTS

Referring now to the drawings wherein reference numerals are used to designate parts throughout the various figures thereof, there is shown in FIG. 1 a schematic of a coplanar waveguide 10, in the prior art. The ground plane 12, a thin film of metal, on this structure is on the top side of the wafer.

The wafer 14 material is GaAs or other suitable semiconductor material on which most microwave integrated circuits are fabricated. The thickness of this wafer, h, in the case of coplanar waveguide is usually kept at 400 microns or higher for ease in handling. This dimension is not critical for propagation characteristics of CPW. The characteristic impedance of the transmission line is mainly determined by the dimensions W and G. In the case of microstrip, wafer thickness h is a critical dimension. This dimension together with the width of top conductor W, determines the characteristic impedance of the transmission line. In this case substrate thickness is usually on the order of 100 microns. The thin substrate allows for via holes to be etched in the wafer to conect top surface components to bottom surface ground.

A microstrip 20, as shown in FIG. 2, has its ground plane 22, a thin film of metal, on the bottom side of the wafer, as shown in FIG. 2. One side of wafer is completely metalized. This is the bottom side of the wafer. The metalization is used as the ground plane for the microstrip line. The role of a transition between these two dissimilar transmission lines is to electrically connect the ground planes of the two lines and also the center conductor of the coplanar waveguide to the top conductor of the microstrip.

Figure 6:
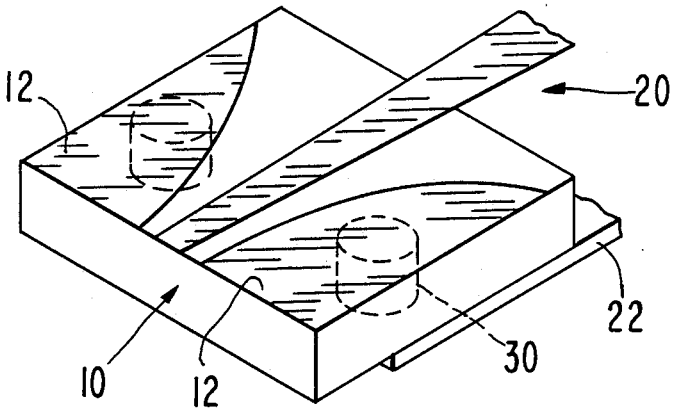
FIG.6 PRIOR ART
FIG. 6 is a schematic perspective view of the tapered microstrip to coplanar waveguide transistion on ceramic.
Figure 7:
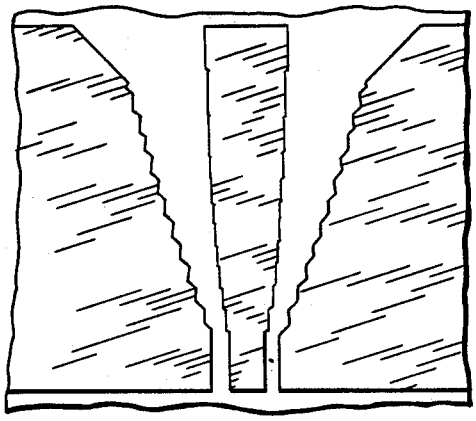
FIG. 7 PRIOR ART
FIG. 7 is a detailed layout of the tapered microstrip to coplanar waveguide transition on ceramic.

At frequencies below 10 GHz, some of the approaches taken are shown in FIGS. 3–5. The planar approach, as shown in FIG. 3, is inherently narrow band. Such narrow band transistions can not be used in conjunction with wideband components such as distributed amplifiers. Also, narrow band interconnections cause signal distortion in fast digital circuits. The nonplanar approaches, as shown in FIGS. 4–5, use bond wires (small sections of gold wire) to connect either the ground planes or the center conductors. At higher frequencies, the bond wire inductance can lead to the excitation of extraneous modes on the coplanar line. (See Riaziat et al., Coplanar Waveguides for MMICs, *Microwave Journal*, June 1987, pp. 125–131; Riaziat et al., Single Mode Operation of Coplanar Waveguides, *Electronics Letters*, Vol. 23, No. 24, Nov. 1987, pp. 1281–1283.) Via holes can be used instead of bond wires to reduce the inductance. However, since one of the advantages of using coplanar waveguides is the possibility of avoiding via holes in the GaAs process, this is not an attractive solution. The via hole process for GaAs monolithic circuits is an expensive and yield limiting step. Via holes in ceramic substrates are more practical since thay are drilled using lasers or ultrasound, and their process is separate from that of the monolithic circuit. Broadband transitions can be designed using via holes in ceramic. An example of this device is shown in FIGS. 6–7. However, since the inductance of a via hole 30 is in general higher than that of the sloped surface used in the invention, these transitions are not as broadband.

Figure 8:
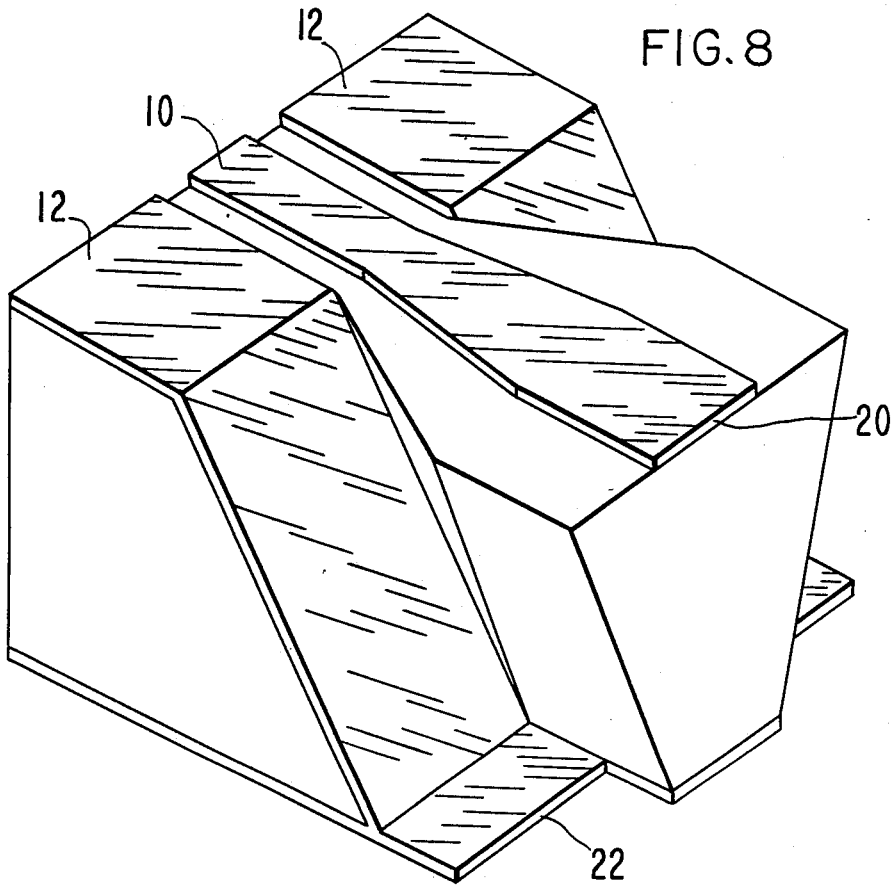
FIG. 8 is a schematic of a microstrip to coplanar waveguide transition on GaAs using anisotropic etching according to the invention.
Figure 9:
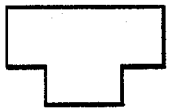
FIG. 9 is a simplified top view of top surface of the device of FIG. 8.
Figure 10:
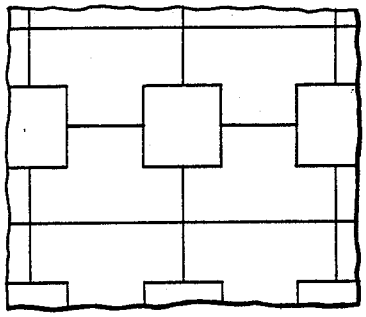
FIG. 10 is diagram of an array of the devices of FIG. 11 on a semiconductor substrate.
Figure 11:
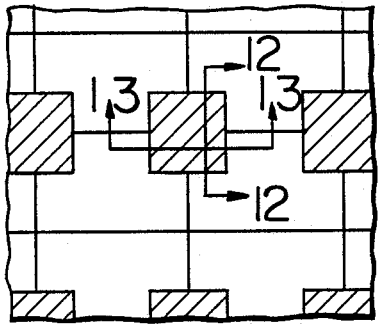
FIG. 11 is a diagram of the same array as in FIG. 10 with the areas to be etched shown in shading.
Figure 12:
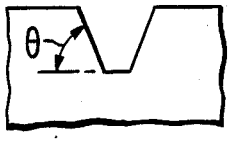
FIG. 12 is a section of the etch along the section line 12—12 on FIG. 11.
Figure 13:
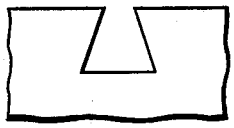
FIG. 13 is a section of the etch along the section line 13—13 on FIG. 11.
Figure 14:
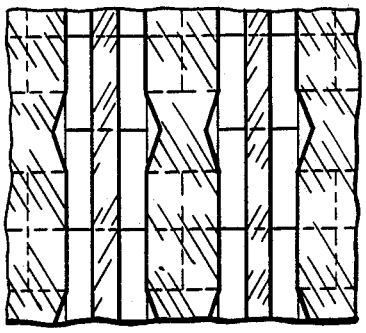
FIG. 14 shows the array of FIG. 11 highlighting the pattern of metallization imposed on the top surface after etching in shading.
Figure 15:
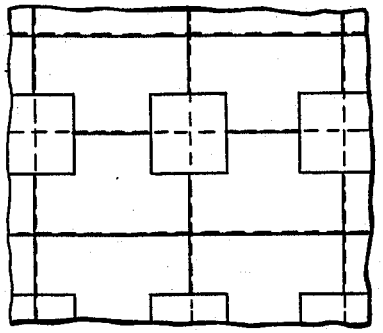
FIG. 15 shows in dotted lines the die separation of the array of FIG. 11 into individual devices.

The approach according to the invention makes use of an anisotropic etching of the GaAs substrate to achieve a sloped surface. This sloped surface, when metalized, makes a low inductance connection between the two ground planes, as shown in FIG. 8. To understand the fabrication method of the device of FIG. 8, FIGS. 9–11, 14–15 should be studied in sequence. FIG. 9 is a simplified schematic top view of top surface of the device of FIG. 8. FIG. 10 shows the layout of an array of the devices of FIG. 8 for batch fabrication on a semiconductor substrate. FIG. 11 shows the etched area shaded. The etch must continue all the way through the semiconductor substrate. Any of the etches used for mesa and gate recess definiation for GaAs FET's will do if GaAs is the chosen material. Because of the slowness of the [111] surface to virtually any wet etch, the wafer should be aligned so that a "vee" will form in the vertical direction, as shown in the section 12—12 of FIG. 11 and FIG. 12. Also, a "dovetail" will form in the orthorgonal direction, as shown in the section 13—13 of FIG. 11 and FIG. 13. The "dovetail" is not necessary for the operation of the device of the invention. If anything, it complicates things. The angle $\theta$ shown in FIG. 12 is approximately 55°. (See: *J. Electrochemical Soc.* 118, p. 118, 1971; *J. Electrochemical Soc.* 128, p. 874, 1981.) The type of etch used is dictated more by the ability of the mask (photoresist etc.) used to stand up to it for a long period of time than anything else. Even dry etching could be used, taking care that the angle $\theta$ lies in the 40° to 70° range. Angles less than 40° will result in an excessively large device and greater than 60° will result in poor metal coverage and a sudden transition from coplanar to microstrip, causing spurious mode generation and larger radiative losses. FIG. 14 shows in shading the metallization pattern superimposed on the array of FIG. 11 after the etching step. FIG. 15 shows in dotted lines where the array is die cut to separate individual devices either by diamond or laser scribing.

Figure 16:
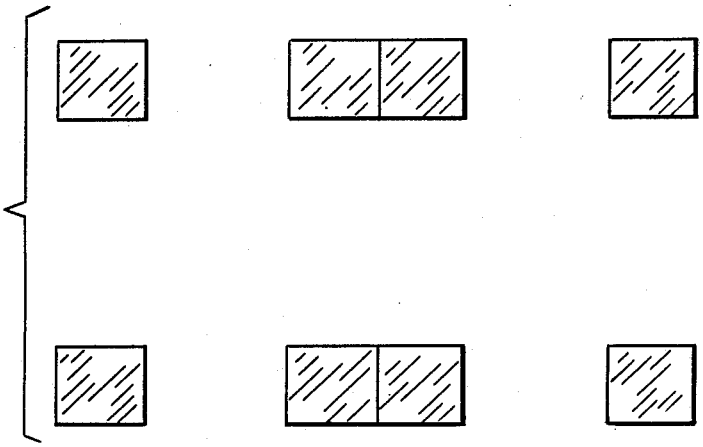
FIG. 16 shows a sample mask used for the substrate etching of the transition device according to the invention.
Figure 17:
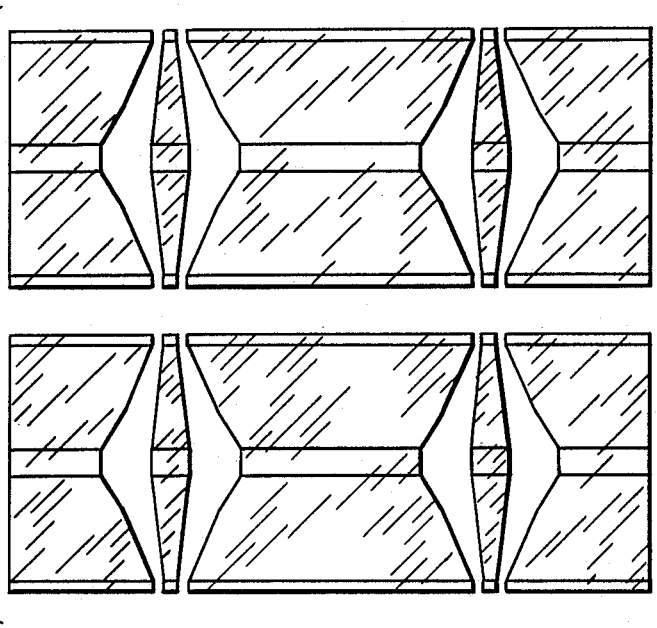
FIG. 17 shows a sample mask used for the top surface metalization of the transition device according to the invention.

Two optical masks are used in the fabrication of the transition. The first mask, shown in FIG. 16, is used for substrate etching using a solution of $H_2SO_4$:$H_2O_2$:$H_2O$. FIG. 17 shows the second mask used for top surface metalization.

An example of the the details of the photolithography steps follows:

(1) GaAs wafer is cleaned using TCE, Acetone, and IPA.

(2) The backside of the wafer is metalized with evaporated Ti/Pt/Au, at 250/150/2600 Å.

(3) The backside of the wafer is coated with AZ 1350J photoresist at 3000 RPM and baked at 80° C. for 30 minutes.

(4) The front surface is liquid primed using HMDS at 6000 RPM, then coated with photoresist according to step (3).

(5) Mask No. 1 as shown in FIG. 16 is used to expose the front side of the wafer with UV400 light at 20 $mW/cm^2$ for 10 seconds. The long side of the rectangles should be aligned parallel to the [011] direction on the wafer.

(6) The resist is developed in AZ 351 developer (5:1), for 30 seconds, and baked at 100° C. for one hour.

(7) The wafer is ashed at 100 W for one minute.

(8) GaAs is etched in a 1:8:1 solution of $H_2SO_4$:-$H_2O_2$:$H_2O$ for 35 minutes (etch rate: 10 μm/min at room temperature).

(9) The photoresist is stripped by Acetone.

(10) Front side of the wafer is coated with AZ 1350J photoresist at 3000 RPM, and baked at 80° C. for 30 minutes.

(11) Mask 2 as shown in FIG. 17 is exposed for 13 seconds and developed according to step 6.

(12) Layers of Ti/Pt/Au are evaporated on the front surface with thicknesses of 150/50/300 Å.

(13) Steps 10 and 11 are repeated.

(14) The wafer is baked at 100° C. for 30 minutes.

(15) 2 microns of Au is electroplated on the surface.

(16) Photoresist and extra metal is removed by a lift-off process in 4-Butyrol Actone.

Figure 18:
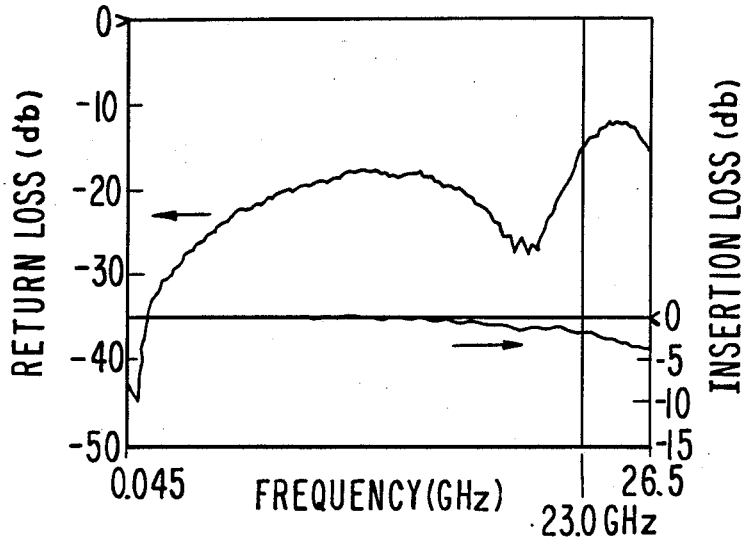
FIG. 18 is a graph of measurements of insertion loss and return loss measured for two back to back transitions.

Measured insertion loss and return loss for two back to back transitions is shown in FIG. 18. As can be seen, 15 dB return loss is achieved with a band width of 23 GHz. This large bandwidth has not been obtained by any of the other transition schemes mentioned.

This invention is not limited to the preferred embodiment and alternatives heretofore described, to which variations and improvements may be made, including mechanically and electrically equivalent modifications to component parts, without departing form the scope of protection of the present patent and true spirit of the invention, the characteristics of which are summarized in the following claims.

What is claimed is:

1. A broadband interconnection device used for interconnection between a microstrip and a coplanar waveguide, comprising:

a monolithic semiconductor wafer having a coplanar waveguide defined at a first edge on an upper surface, said coplanar waveguide including a conductor and a pair of ground planes, a conductor of a microstrip defined on an opposite edge of said top surface, and a ground plane of said microstrip on a bottom surface, said conductor of said coplanar waveguide being electrically connected to said conductor of said microstrip;

a pair of sloped surfaces in said monolithic semiconductor wafer, said surfaces sloping from said pair of ground planes of said coplanar waveguide on said upper surface to said ground plane of said microstrip on said bottom surface, said pair of sloped surfaces being metalized with high conductivity metal, said high conductivity metal being in contact with said ground plane of said microstrip and said ground planes of said coplanar waveguide.

2. The device of claim 1 wherein said sloped surface is formed by anisotropic etching.

3. The device of claim 1 wherein said sloped surface subtends an angle of no less than forty degrees and no more than seventy degrees with said ground planes.

* * * * *